US007390177B2

(12) United States Patent
Iversen et al.

(10) Patent No.: US 7,390,177 B2
(45) Date of Patent: Jun. 24, 2008

(54) PISTON COMPRESSOR, PARTICULARLY A HERMETIC REFRIGERANT COMPRESSOR

(75) Inventors: Frank Holm Iversen, Padborg (DK); Marten Nommensen, Flensburg (DE)

(73) Assignee: Danfoss Compressors GmbH, Flensburg (DE)

( * ) Notice: Subject to any disclaimer, the term of this patent is extended or adjusted under 35 U.S.C. 154(b) by 674 days.

(21) Appl. No.: 10/847,280

(22) Filed: May 17, 2004

(65) Prior Publication Data

US 2005/0008517 A1 Jan. 13, 2005

(30) Foreign Application Priority Data

May 22, 2003 (DE) ..... 103 23 767
Jul. 7, 2003 (DE) ..... 103 30 760

(51) Int. Cl.
*F04B 39/10* (2006.01)

(52) U.S. Cl. ..... 417/571; 417/569; 137/855

(58) Field of Classification Search ..... 417/569, 417/571; 137/855, 856, 512, 315.33
See application file for complete search history.

(56) References Cited

U.S. PATENT DOCUMENTS 2,043,849 A * 6/1936 Bixler ..... 137/856
4,098,296 A * 7/1978 Grasso et al. ..... 137/855
4,238,172 A 12/1980 Abe et al.
5,328,338 A * 7/1994 Hirano et al. ..... 417/312
5,577,901 A * 11/1996 Yoon ..... 417/571
5,709,535 A * 1/1998 Enomoto et al. ..... 417/269
6,305,912 B1 10/2001 Svendsen et al.

FOREIGN PATENT DOCUMENTS

GB 1 246 256 9/1971

* cited by examiner

*Primary Examiner*—Devon Kramer
*Assistant Examiner*—Peter J Bertheaud
(74) *Attorney, Agent, or Firm*—McCormick, Paulding & Huber LLP

(57) ABSTRACT

The invention concerns a piston compressor, particularly a hermetic refrigerant compressor, with a compression chamber, which is limited by a valve plate arrangement having a valve plate with a suction gas opening and a pressure gas opening, a suction valve plate with a suction valve element, and a pressure valve plate with a pressure valve element. It is endeavoured to achieve a good efficiency combined with a simple assembly. For this purpose, it is ensured that the pressure valve plate and the suction valve plate are located on the side of the valve plate facing the compression chamber.

23 Claims, 7 Drawing Sheets

PISTON COMPRESSOR, PARTICULARLY A HERMETIC REFRIGERANT COMPRESSOR

CROSS-REFERENCE TO RELATED APPLICATIONS

This application is entitled to the benefit of and incorporates by reference essential subject matter disclosed in German Patent Application No. 103 23 767.4 filed on May 22, 2003 and German Patent Application No. 103 30 760.5 filed on Jul. 7, 2003.

FIELD OF THE INVENTION

The invention concerns a piston compressor, particularly a hermetic refrigerant compressor, with a compression chamber, which is limited by a valve plate arrangement having a valve plate with a suction gas opening and a pressure gas opening, a suction valve plate with a suction valve element, and a pressure valve plate with a pressure valve element.

BACKGROUND OF THE INVENTION

Such a refrigerant compressor is known from, for example, DE 199 15 918 C2. A suction valve is fixed on the valve plate bottom side facing the compression chamber. A pressure valve is fixed on the opposite valve plate upper side, where it is located in a recess. A sealing is located between the cylinder adopting the compression chamber and the valve plate, and an additional sealing is located between the valve plate and the cylinder head cover. Together with a partition wall formed in the cover, this additional sealing ensures that the suction side and the pressure side are separated from each other. For this purpose, it is required that the complete cylinder head arrangement be assembled by means of screw bolts and fixed on the cylinder. In order to achieve a sufficient tightness, high tightening forces are required. Further, only narrow manufacturing tolerances are permitted. When the separation between the suction side and the pressure side is not realised satisfactorily, compressed, and thus hot, gas from the pressure side can reach the suction side, which reduces the efficiency of the compressor.

The tightening forces, which can be achieved with screws, are limited. Also, the forces, with which the parts forming the cylinder head are assembled, cannot in other ways be increased to a value exceeding a predetermined value, as this would cause a too high material strain.

SUMMARY OF THE INVENTION

The invention is based on the task of achieving a good efficiency, also with simple mounting.

With a piston compressor as mentioned in the introduction, this task is solved in that the pressure valve plate and the suction valve plate are located on the side of the valve plate facing the compression chamber.

Thus, the pressure valve plate and the suction valve plate are no longer located on different sides of the valve plate, on the contrary, they are located on the same side of the valve plate, namely on the side facing the compression chamber. In this connection, the fact is utilised that the suction valve plate and the pressure valve plate are usually substantially thinner than the valve plate. This means that the suction valve plate and the pressure valve plate are more flexible than the valve plate, that is, they can bear more closely on each other, when the forces used for tightening are smaller. Further, an additional advantage occurs. The fact that the compressed gas no longer has to pass through the valve plate before reaching the pressure valve causes that the dead space is reduced. This improves the efficiency of the compressor. A projection, often formed on the front side of a piston reducing the compression chamber, which projects into the pressure gas opening of the valve plate in the upper dead point position, thus reducing the damaging dead volume, is no longer required. Locating not only the suction valve plate but also the pressure valve plate on the side of the valve plate facing the compression chamber simplifies the manufacturing. Usually, it is no longer required to fit sealings between the valve plate, the suction valve plate and the pressure valve plate.

Preferably, the suction valve plate forms a pressure valve seat for the pressure valve element and the pressure valve plate forms a suction valve seat for the suction valve element. Thus, the working required for manufacturing the valve seat could be limited to the suction valve plate and the pressure valve plate. This working, if required at all, then takes place on the sides of the suction valve plate and the pressure valve plate, which bear on each other in the mounted state. This further improves the tightness.

It is particularly preferred that, with intermediate mounting of a reinforcement plate, the pressure valve plate and the suction valve plate are located on the side of the valve plate, which exists in the form of a stiffening element, facing the compression chamber. However, the valve plate, which exists in the form of a stiffening element, is not limited to a substantially plane embodiment. It can also perform other functions, for example be part of a muffling arrangement or other parts of the cylinder head. However, still the valve plate ensures that the limiting wall of the compression chamber adopting the valves is rigid and mechanically stable. However, it is an advantage that the suction valve plate and the pressure valve plate are usually substantially thinner than the traditional valve plate. Thus, the suction valve plate and the pressure valve plate are more flexible than the valve plate. The flexibility of the suction valve plate and the pressure valve plate makes it possible for both plates to bear more closely on bearing surfaces, also when the forces used for tightening are smaller. In principle, an improved tightness will thus occur. However, the flexible embodiment of the suction valve plate involves the risk that, during a suction stroke, when suction pressure rules in the compression volume, the suction valve plate sags in the area of the environment of the pressure valve. During a suction stroke, the previously generated pressure namely rules here. In many cases, a flexible suction valve plate is not stable enough to adopt the forces occurring through the pressure difference without significant bending. Under certain circumstances, a repeated deformation will cause a fatigue fracture of the suction valve plate. The deformation is now effectively prevented or at least substantially reduced by the reinforcement plate. The reinforcement plate does not have to be substantially more stable than the suction valve plate. Also with a relatively weakly dimensioned reinforcement plate, the sag of the suction valve plate can be reduced to a harmless extent.

Preferably, the suction valve plate, the reinforcement plate and the pressure valve plate have substantially the same thickness. However, their thicknesses do not have to be exactly the same. Deviations from 50% downward and 100% upwards are permissible. The thickness of the reinforcement plate will be chosen in dependence of the magnitude of the pressure ruling on the pressure side in such a manner that fatigue fractures of the suction valve plate are avoided. This means that the thickness of the reinforcement plate will be chosen so that it provides a sufficient support. On the other hand, the thickness of the reinforcement plate will be kept as small as possible to avoid an excessive increase of the harmful volume in the pressure opening.

Preferably, the reinforcement plate forms a pressure valve seat for the pressure valve element and a suction valve seat for the suction valve element. Thus, the workings, which are required for the manufacturing of the valve seats, can be limited to the reinforcement plate. If required at all, this working then occurs on the two sides of the reinforcement plate, which bear on the suction valve plate or the pressure valve plate, respectively, in the mounted state. This further improves the tightness.

Preferably, the suction valve plate, in relevant cases the reinforcement plate and the pressure valve plate are made of spring steel. In this case, spring steel has several advantages. Firstly, the suction valve element and the pressure valve element can be made in one piece with the suction valve plate and the pressure valve plate, respectively, for example as a flexible tongue. Secondly, spring steels can be formed relatively plane, so that a safe closing of the suction opening and the pressure opening in the suction valve plate and the pressure valve plate can be ensured in a simple manner.

Preferably, the valve plate, the pressure valve plate and the suction valve plate, or the valve plate, the pressure valve plate and the reinforcement plate and, in some cases, the suction valve plate are undetachably connected with each other. In this case, undetachably means that the three or four plates cannot be detached from each other by removing an auxiliary assembling part, for example a screw. Of course, if required, it is possible to use auxiliary assembling parts to connect the plates additionally to the undetachable connection.

In this connection, preferably a connection is provided, which connects the valve plate, the pressure valve plate and the suction valve plate, or the valve plate, the pressure valve plate and the reinforcement plate and, in relevant cases, the suction valve plate, at a common position. For example, the suction valve plate and the valve plate are connected through the pressure valve plate. When a reinforcement plate is available, it may be ensured that the suction valve plate and the valve plate in the form of a stiffening element are connected through the reinforcement plate and the pressure valve plate.

Advantageously, the connection is made in the form of a line, which surrounds an area around a pressure valve. Then, the connection is not used to provide a mechanical cohesion between the suction valve plate, in relevant cases the reinforcement plate, the pressure valve plate and the valve plate. At the same time, the connection forms a sealing line, which surrounds the area around the pressure valve, so that pressure gas, which passes the pressure valve, may reach this line, but cannot penetrate the connection along this line. In this connection, the term "line" must be understood functionally. Of course, the connection along this line may have a certain width.

Preferably, the connection is made as a welded connection. Such a welded connection is easily manufactured. A welded connection has the advantage that with the welding several elements can be fixed to each other at the same time, that is, the suction valve plate, in relevant cases the reinforcement plate, the pressure valve plate and the valve plate can be connected with each other. In some cases it can be avoided to weld the suction valve plate onto the other elements of the stack, when the tightness between the suction valve plate and the reinforcement plate can be ensured otherwise. Such a welding can preferably be made without adding electrode material, for example by means of a laser beam. After alignment of the valve plate, the suction valve plate, in relevant cases the reinforcement plate and the pressure valve plate in relation to each other, such a laser beam is directed onto the surface of the suction valve plate and then moved along the line. Thus, not only the suction valve plate, in relevant cases the reinforcement plate, the pressure valve plate and the valve plate are connected with each other, but at the same time, a sealing around the pressure valve is produced. Such a method is not only possible with a welding process, but can also be used with an electron beam process.

It is preferred that the suction valve plate has at least one slot-like opening, which follows the course of the line. Of course also more than one slot-like opening can be provided. Particularly, when the connection between the three or four plates is realised by means of a welding, the slot-like opening (s) has/have advantages. A possibly occurring welding bead will be adopted by the opening, that is, it does not project into the compression chamber. Thus, the dead volume of the compressor can be further minimised. In its upper dead point, the piston can namely be set to a smaller distance to the suction valve plate, as it would be possible, when a welding bead existed. These considerations also apply, when the connection is not made as a welded connection, but as a soldered or glued connection. Also in this case, the slot-like openings can adopt possibly occurring projecting. Also the reinforcement plate may have corresponding slot-like openings, so that also inside the plate package comprising the four plates interfering welding or gluing beads cannot occur.

Preferably, the side of the valve plate facing the compression chamber has a bearing surface for the pressure valve element located in the pressure gas opening. Thus, the bearing surface serves as retainer bridge. A separate retainer bridge for the pressure valve element is no longer required. In principle, the element called valve plate could also be regarded as "retainer bridge", so that with the present embodiment the valve plate in its traditional form is practically omitted.

Preferably, the valve plate, the pressure valve plate, in relevant cases the reinforcement plate and the suction valve plate has corresponding recesses in the area of their circumferences, in which projections of a cylinder element surrounding the compression chamber engage. Together with the recesses, the projections serve the purpose of aligning the suction valve plate, in relevant cases the reinforcement plate, the pressure valve plate and the valve plate in relation to each other in the correct angular positions. This further simplifies the mounting.

Preferably, the valve plate arrangement bears with intermediate mounting of a sealing on a bearing surface of the cylinder element, which is formed by a diameter extension of the cylinder element. This sealing ensures that during a compression process, that is, during a reduction of the compression chamber, gas cannot leak from the compression chamber at an undesired spot. The discharge of the gas from the compression chamber is thus limited to its way through the pressure valve. The sealing can equalise possibly occurring unevennesses. It is, for example, made of an elastomer.

Preferably, the valve plate arrangement is connected with a flange surrounding the bearing surface, and compresses the sealing. Such a connection can, for example, be made by means of welding. However, the connection can also be made by bordering the flange. Before the welding or bordering, a pressure is exerted on the valve plate arrangement, which causes a compression of the sealing. In this compressed state, a welding is then made. Such a welding can, for example in the circumferential direction, lead to a closed welding seam, which further improves the tightness.

Preferably, the recesses in the valve plate only penetrate partly through the thickness of the valve plate. This involves the advantage that the "upper side" of the valve plate, that is, the side facing the compression chamber, is plane. Thus, the recesses do not have to be additionally closed or taken into consideration in other ways.

Preferably, a recess surrounds the suction gas opening and/or the pressure gas opening in the valve plate. A connector of a suction muffler or a pressure muffler, respectively, can be inserted in such a recess, so that also on the side of the valve plate facing away from the compression chamber an excellent separation of the suction side from the pressure side can be realised.

BRIEF DESCRIPTION OF THE DRAWINGS

In the following, the invention is described on the basis of preferred embodiments in connection with the drawings showing.

DETAILED DESCRIPTION OF THE PREFERRED EMBODIMENTS

Figure 1:
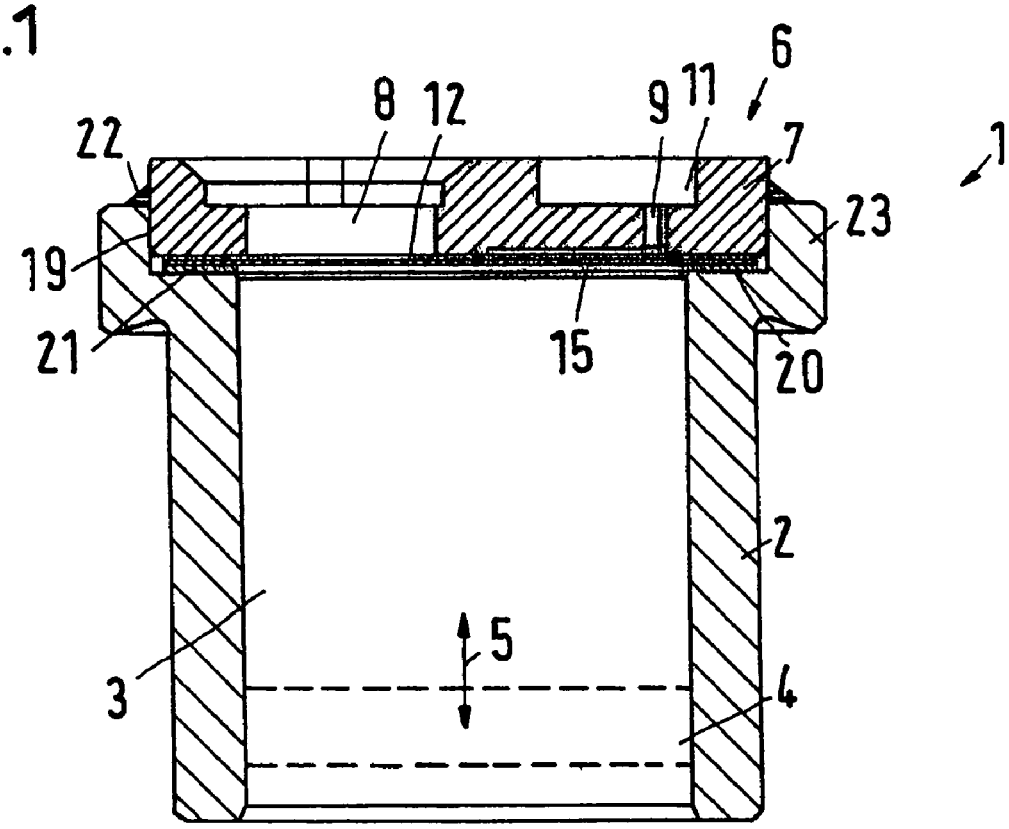
FIG. 1 is a schematic sectional view of a piston compressor
Figure 2A:
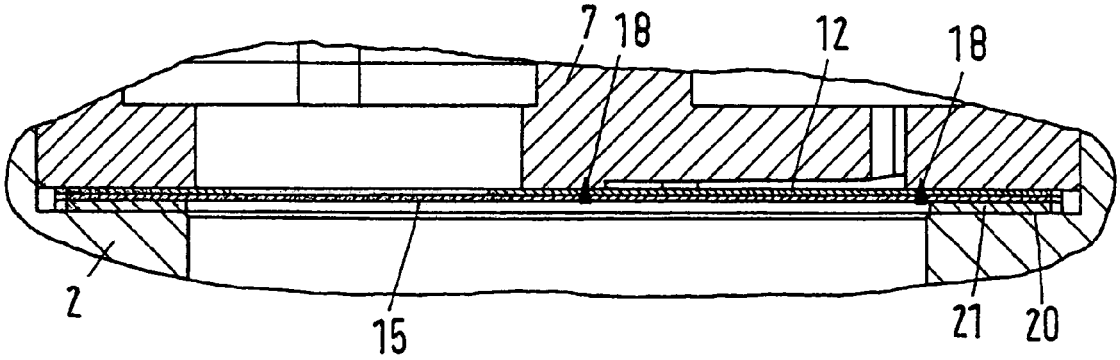
FIG. 2*a* is an enlarged section from FIG. 1 of a valve plate arrangement with three plates
Figure 10:
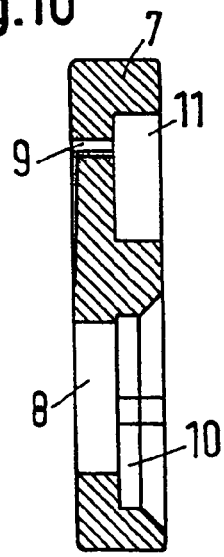
FIG. 10 is a sectional view X-X according to FIG. 8
Figure 11:
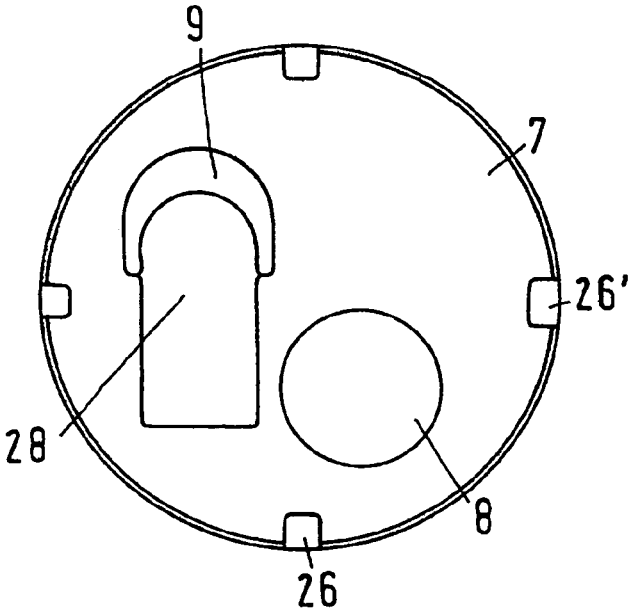
FIG. 11 is a view of the valve plate from the side of the compression chamber

A piston compressor 1, shown schematically in FIG. 1, has a cylinder element 2, which surrounds a compression chamber 3 in the circumferential direction. On a front side, the compression chamber 3 is bordered by a merely schematically shown piston 4, which is movable in the direction of a double arrow 5. On the side facing the piston 4, the compression chamber 3 is bordered by a valve plate arrangement 6, which will be described in detail in the following. For reasons of clarity, other elements, like suction muffler, pressure muffler, cylinder head cover or the like are not shown, can, however, be fitted accordingly by the person skilled in the art according to needs. 40 The valve plate arrangement 6 with three plates in FIG. 2*a* shows a valve plate 7, which is penetrated by a suction gas opening 8 and a pressure gas opening 9. The valve plate arrangement 6 with four plates in FIG. 2*b* has a valve plate 7 in the form of a stiffening element, which is also penetrated by the suction gas opening 8 and the pressure gas opening 9. The valve plate 7 in the form of a stiffening element is here made as a plate. However, with this valve plate 7 in the form of a stiffening element, the plane or plate-like shape is not absolutely required. As can also be seen from FIG. 10, a recess 10 surrounds the suction gas opening 8. A recess 11 surrounds the pressure gas opening 9. In both recesses, connection pipes, not shown in detail, from suction mufflers or pressure mufflers, respectively, can be inserted. It is also possible to connect these connection pipes fixedly with the valve plate 7, for example by means of gluing or welding. In this case, a cylinder head cover may, under certain circumstances, be avoided.

Figure 6:
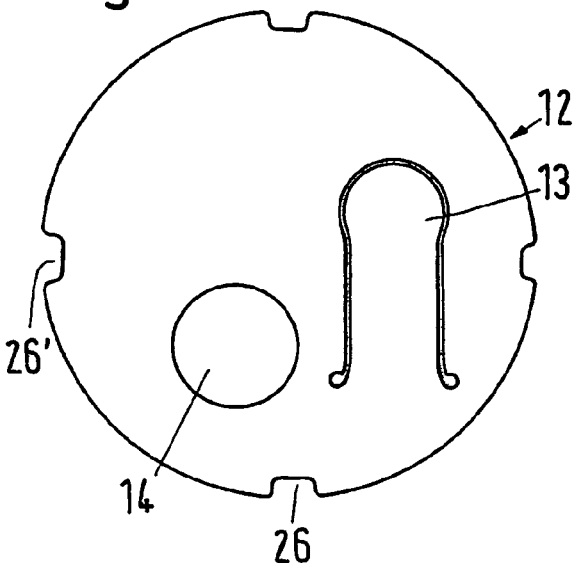
FIG. 6 is a pressure valve plate
Figure 8:
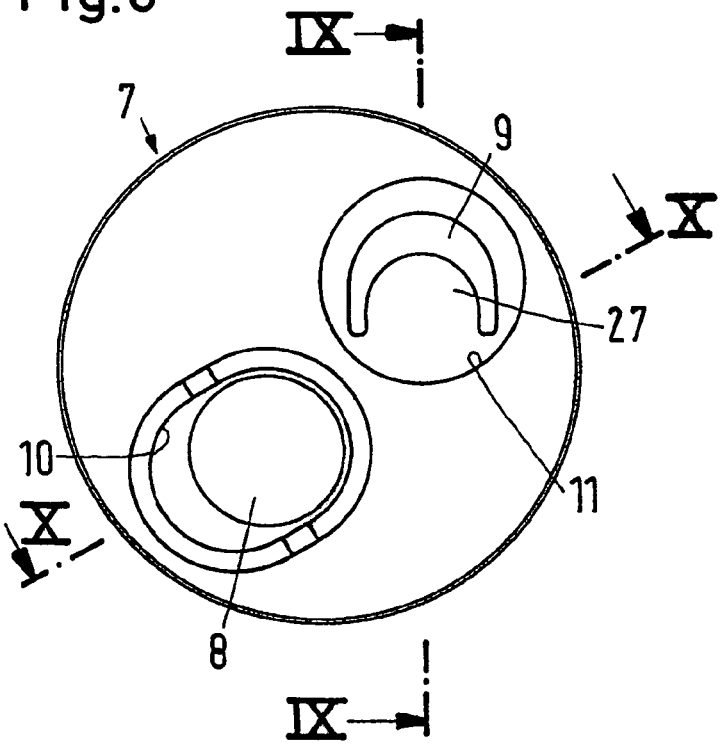
FIG. 8 is a valve plate from the side facing away from a compression chamber.

On the side of the valve plate 7 facing the compression chamber 3, firstly a pressure valve plate 12 bears, which has (FIG. 6) a pressure valve element 13 in the form of a flexible tongue. Further, the pressure valve plate has a suction opening 14, which is merely formed by a hole in the pressure valve plate 12.

On the side of the pressure valve plate 12 facing the compression chamber 3 bears, according to FIG. 2*a*, a suction valve plate 15. On the side of the pressure valve plate 12 facing the compression chamber 3 bears, according to FIG. 2*b*, a reinforcement plate 40 (FIG. 12), which also has a pressure gas opening 41 and a suction gas opening 42, which are formed by holes in the reinforcement plate 40.

On the side of the reinforcement plate 40 facing the compression chamber 3 bears a suction valve plate 15. The suction valve plate has (FIG. 5) a suction valve element 16 and a pressure opening 17. The suction valve element 16 is also made as a flexible element. The pressure opening 17 is merely a circular hole.

Both the pressure valve plate 12 and the suction valve plate 15 are made of spring steel. Also the reinforcement plate 40 is made of spring steel. In the present embodiment, spring steel has the advantage that both the pressure valve element 13 and the suction valve element 16 can be made in one piece with the pressure valve plate 12 or the suction valve plate 15, respectively. However, the valve elements 13, 16 can be made separately from the valve plates 12, 15, and then be fitted together with the valve plates 12, 15. Further, spring steel is relatively thin and can be provided with a surface, which ensures that the pressure valve plate 12, in relevant cases the reinforcement plate and the suction valve plate 15 bear sealingly on each other.

With a valve plate arrangement with three plates according to FIG. 2*a*, the suction valve plate 15 forms, together with the pressure opening 17, a valve seat 29 for the pressure valve element 13. The pressure valve plate 12 forms, together with the suction opening 14, a valve seat 30 for the suction valve element 16. In the valve plate arrangement with four plates according to FIG. 2*b*, the reinforcement plate 40 forms, together with the pressure opening 41 a valve seat 29 for the pressure valve element 13. The reinforcement plate 40 forms, together with the suction opening 42, a valve seat 30 for the suction valve element 16 (FIG. 3). According to the views in FIGS. 5 and 6, the pressure valve plate 12 is folded onto the suction valve plate 15.

Figure 12:
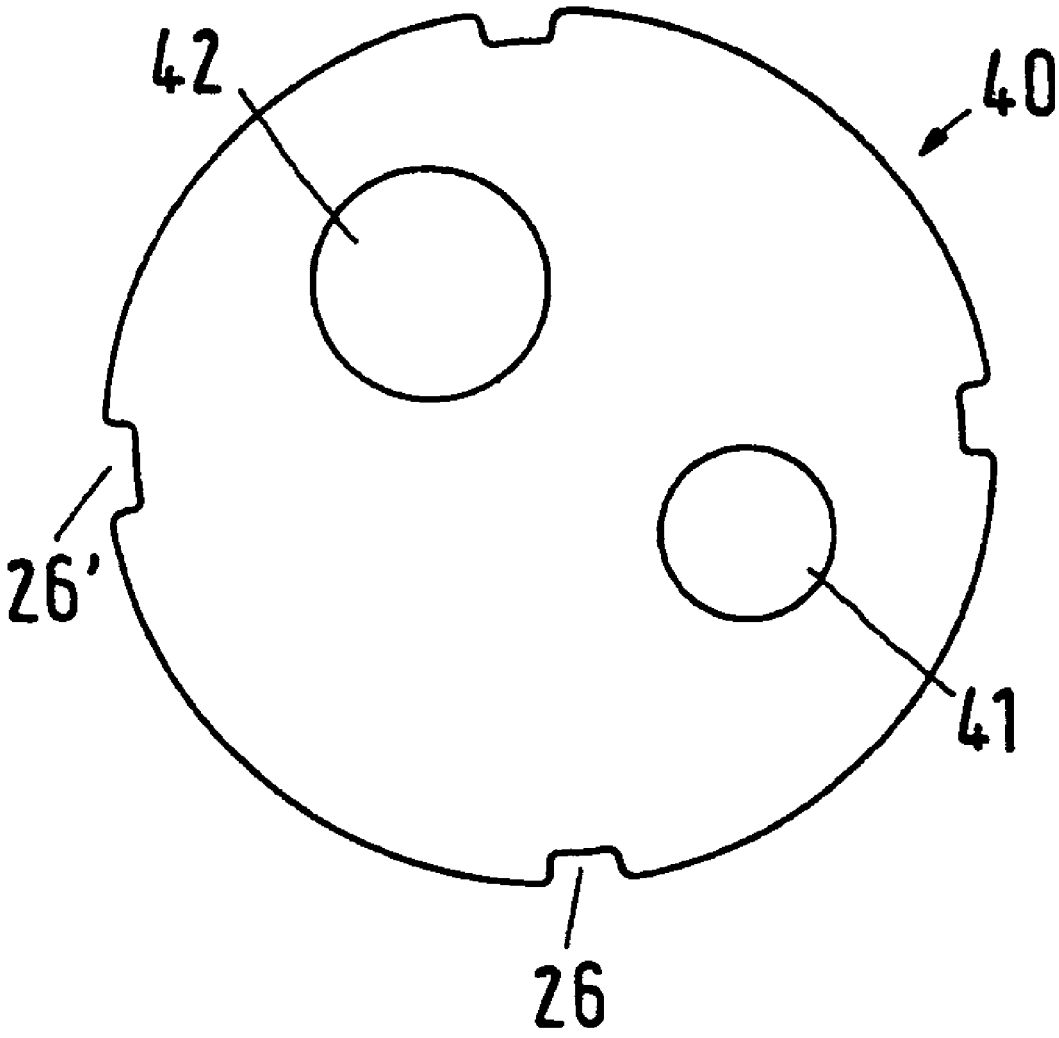
FIG. 12 is a view of a reinforcement plate

FIG. 12 shows a top view of the reinforcement plate 40.

Figure 13:
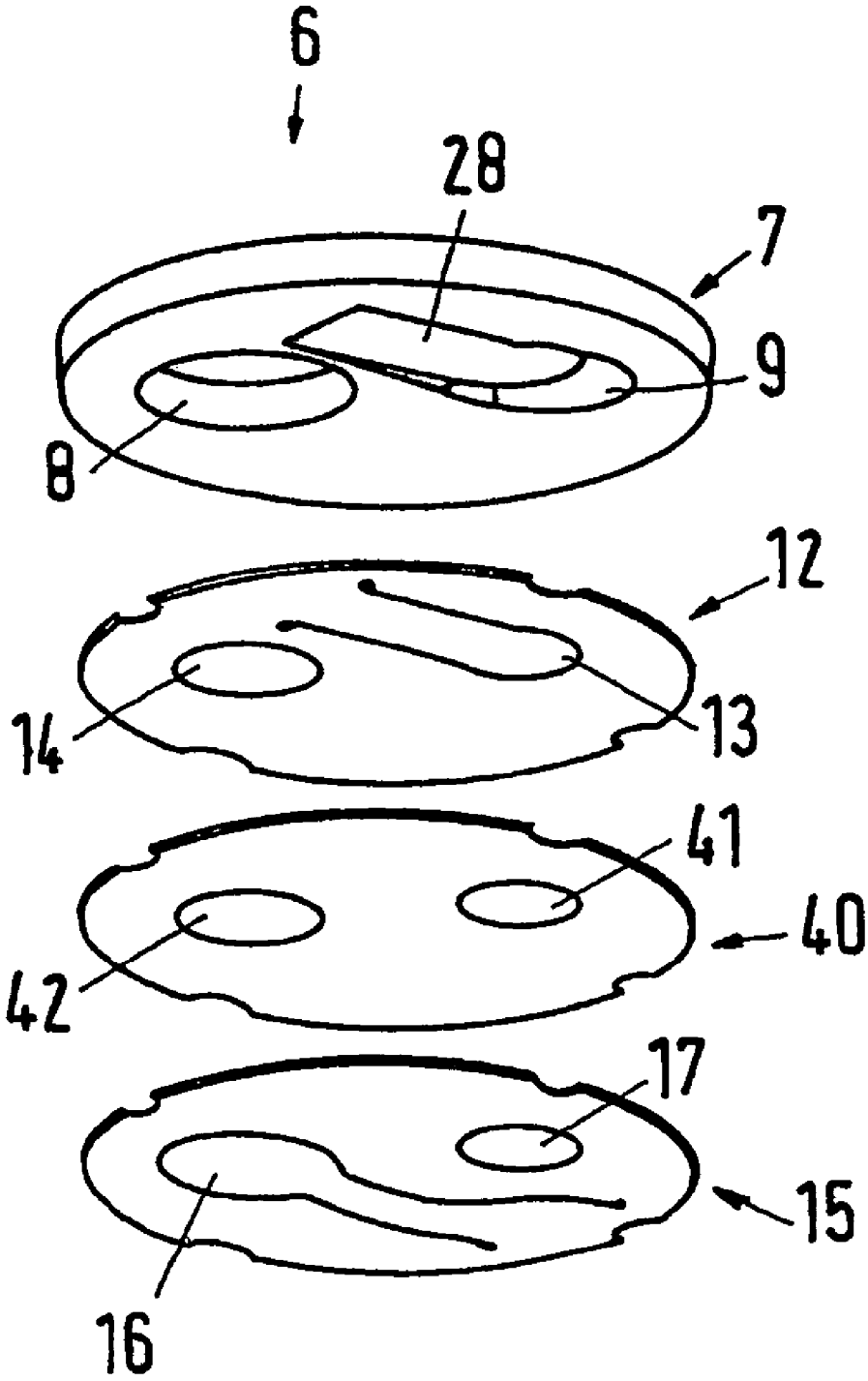
FIG. 13 is a perspective exploded view of the valve plate arrangement.

FIG. 13 shows a perspective exploded view of the valve package or the valve arrangement 6, which is formed by the valve plate 7, the pressure valve plate 12, the reinforcement plate 40 and the suction valve plate 15. From this figure, the relative allocations of the individual suction openings 8, 14, 42 and the individual pressure openings 9, 41, 17 can be seen.

As appears from FIG. 2*a*, the pressure valve plate 12, the suction valve plate 15 and the valve plate 7 are connected with each other by means of a welded seam 18. In this connection, the welded seam penetrates the pressure valve plate 12.

Figure 2B:
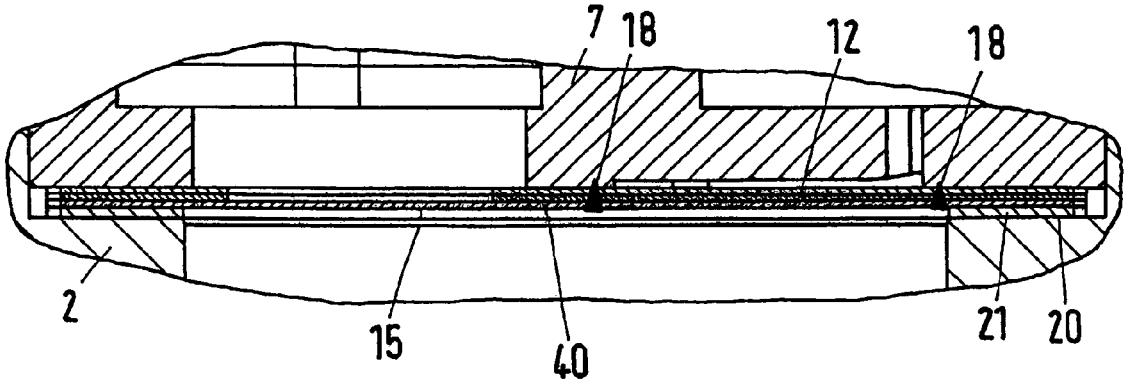
FIG. 2*b* is an enlarged section from FIG. 1 of a valve plate arrangement with four plates
Figure 3:
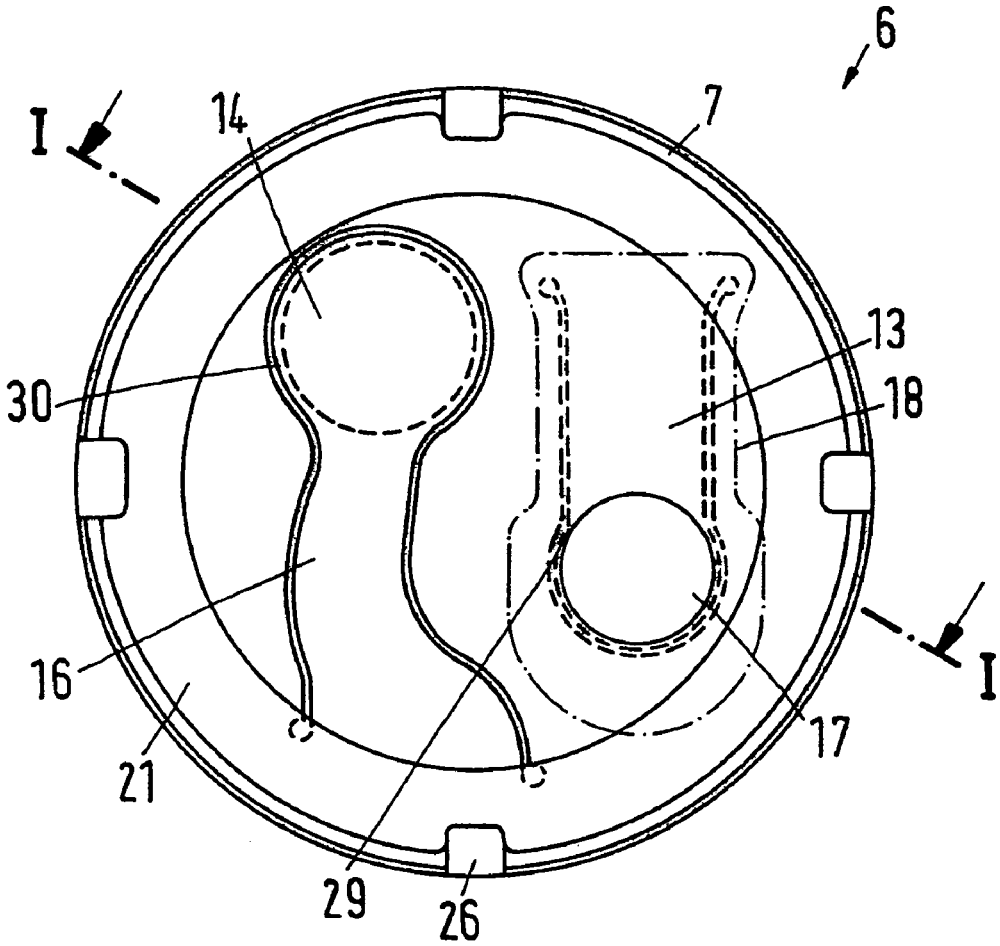
FIG. 3 is a view of a valve plate arrangement seen from the piston

As appears from FIG. 2*b*, the pressure valve plate 12, the reinforcement plate 40, the suction valve plate 15 and the plate 7 are connected with each other by means of a welded seam 18. In this connection, the welded seam 18 penetrates the pressure valve plate 12 and the reinforcement plate 40.

As appears particularly from FIG. 3, the welded seam 18 surrounds an area around the pressure valve. Thus, it surrounds the pressure valve element 13 and the pressure opening 17, according to FIG. 2*b* also the pressure opening 41 at a certain distance. The welded seam 18 is made to be gas tight, that is, it surrounds a pressure gas area, from which the compressed gas cannot escape during the upward movement of the piston 4.

For the welding, for example, a laser can be used, which is directed to the surface of the suction valve plate 15, after aligning of the valve plate 7, the pressure valve plate 12, in relevant cases the reinforcement plate 40 and the suction valve plate 15 in relation to each other. The beam intensity of the laser is controlled so that the material of the parts mentioned is only molten in a relatively narrow area. This keeps the risk small that the valve plates mentioned, 7, 12, 15 and in relevant cases 40, are distorted. This is not only possible with a laser welding process; also an electron beam process can be used.

With the welded seam 18, an undetachable connection is made between the valve plate 7, the pressure valve plate 12, in relevant cases the reinforcement plate 40 and the suction valve plate 15. On the one hand, this connection keeps the valve plates 7, 12, 15, and in relevant cases the reinforcement plate 40, firmly together, and on the other hand, it ensures that gas passing the pressure valve cannot leak to other areas.

Of course, also other connection methods can be used, for example, soldering or gluing processes. In certain cases, also auxiliary assembling parts, like rivets or the like, can be used, the auxiliary assembling parts, however, not taking over the only connection, when they cannot take over the additional task of sealing around the pressure gas area.

For adopting the valve plate arrangement 6, the cylinder element 2 has a diameter extension 19. This diameter extension 19 forms a support face 20, that is, a sort of offset front side of the cylinder element 2, on which the valve plate arrangement 6 is supported under insertion of a sealing 21. The valve plate arrangement 6 is then loaded in the direction of the cylinder element 2 in such a way that the sealing 21 is compressed. Then the valve plate arrangement 6, or rather the valve plate 7, is connected, by means of a welded connection 22, with a circumferential flange 23 of the cylinder element 2, so that the sealing 21 remains compressed. The welded connection 22 can also be replaced by another connection kind, for example a bordering connection. In this connection, it is expedient, when the flange 23 projects over the valve plate arrangement 6 or the valve plate arrangement 6 has a circumferential groove, in which a corresponding bordering edge can engage.

The sealing 21 seals the compression chamber 3 in the area of the end facing the valve plate arrangement 6, thus preventing that compressed refrigerant gas escapes to the outside here. The only way for the refrigerant gas to leave the compression chamber 3 remains the pressure opening 17, when it is released by the pressure valve element 13.

Figure 5:
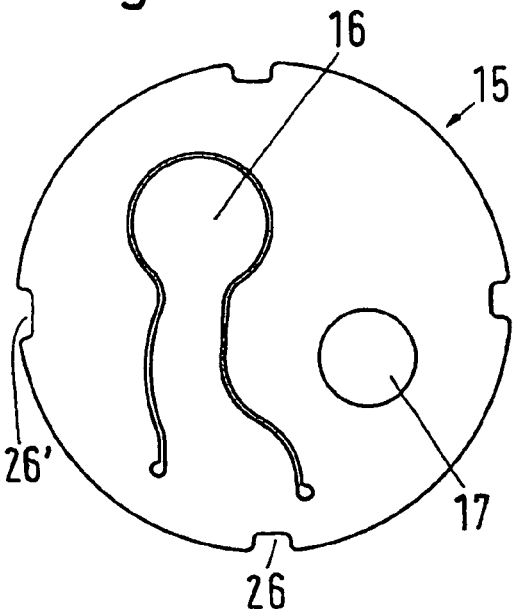
FIG. 5 is a suction valve plate
Figure 7:
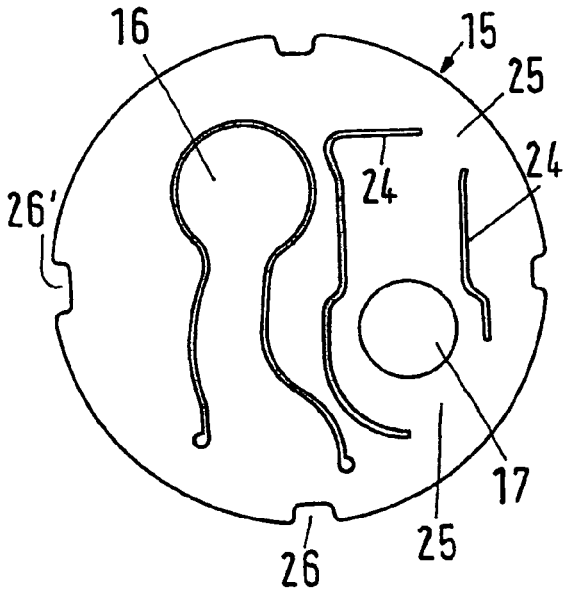
FIG. 7 is a modified embodiment of a suction valve plate

FIG. 7 shows an embodiment of a suction valve plate 15, which is somewhat modified in relation to the embodiment shown in FIG. 5. The same parts have the same reference numbers.

Slits 24 have been added, which extend along the welded seam 18 shown. The slits are meant for preventing that during welding of the valve plate 7 with the suction valve plate 15, in relevant cases the reinforcement plate 40, and the pressure valve plate 12, molten metal leaves a welding bead to project from the surface of the suction valve plate 15. This would require a larger safety distance to the piston and thus cause an increased dead volume. When the slits 24 are provided, the unavoidable welding bead is located in the slit. Accordingly, this also applies, when a soldering seam or a gluing seam replaces the welding seam 18. Alternatively to the slit, stamps may be provided in the valve plate 7, in relevant cases in the reinforcement plate 40 and in the suction and pressure valve plates 12, 15, said stamps pointing away from the compression chamber 3.

The slits 24 have interruptions 25. These interruptions are located where the sealing 21 is supported on the side of the suction valve plate 15 facing the compression chamber 3. Here, a bead can still project from the surface of the suction valve plate 15. However, this area is outside the cross-section of the compression chamber 3 and is adopted by the sealing ring 21.

Figure 4:
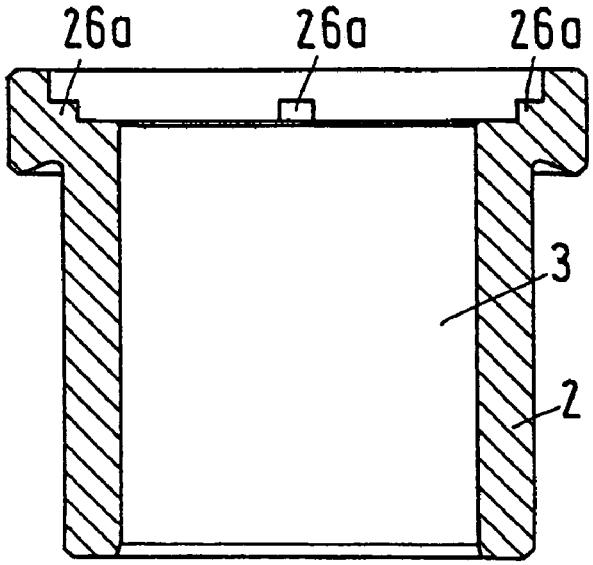
FIG. 4 is a view of a cylinder element in the longitudinal section

Both the pressure valve plate 12 and the suction valve plate 15, and in relevant cases the reinforcement plate 40, have several recesses 26, 26' distributed in the circumferential direction, which correspond to projections 26*a* on the cylinder element 2 (FIG. 4). Also the valve 7 has corresponding recesses 26, 26'. As shown, the recesses 26, 26' can be distributed evenly in the circumferential direction. However, one of the recesses is broader than the others, so that it is ensured that the valve plates 7, 12, 15, and in relevant cases 40, can only be assembled in one predetermined angular orientation.

The valve plate 7 can be seen in the FIGS. 8 to 11. From a comparison of the FIGS. 8 and 11 it appears that the recesses 26, 26' in the valve plate 7 do not penetrate through the whole thickness. Thus, the recesses 26, 26', do not interfere with the topside of the valve plate 7 shown in FIG. 8, which is facing away from the compression chamber. The same applies for the upper area of the circumference of the valve plate 7. This makes it easier to make the welded connection 22 tight.

Figure 9:
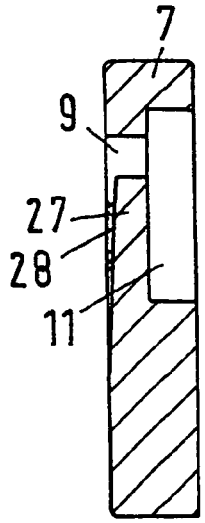
FIG. 9 is a sectional view IX-IX according to FIG. 8

FIG. 9 shows that a projection 27 projects laterally into the pressure gas opening 9, which projection 27 forms a bearing surface 28 for the pressure valve element 13. The bearing surface 28 limits the movement of the pressure valve element 13, when compressed refrigerant gas is discharged from the compression chamber 3. Thus, the bearing surface 28 replaces a separate retainer bridge, which is otherwise usually provided to protect the pressure valve element 13 from damages during opening.

FIG. 3 now shows the design of a valve plate arrangement 6 with the individual valve elements. The pressure valve element 13 bears on the pressure valve seat 29, which, according to FIG. 2*a*, is formed on the side of the suction valve plate 15 facing away from the compression chamber 3, and according to FIG. 2*b* on the side of the reinforcement plate 40 facing away from the compression chamber 3. The suction valve element 16 bears on the suction valve seat 30, which is formed on the side of the pressure valve plate 12 facing the compression chamber 3. The fact that merely the suction valve plate 15, and in relevant cases the reinforcement plate 40, is located between the compression chamber and the pressure valve plate 12, makes it possible to keep the undesired dead volume between the pressure valve element 13 and the compression chamber 3 relatively small. It is practically limited to the thickness of the suction valve plate 15, when the valve plate arrangement comprises three plates, and to the sum of the thicknesses of the suction valve plate 15 and the reinforcement plate 40, when the valve plate arrangement comprises four plates. This thickness is in the area of some tenths of a mm. Additional measures for keeping the dead volume small are not required. Also without additional measures an excellent efficiency of the compressor can be achieved.

The reinforcement plate 40 prevents that the area of the suction valve plate 15, which is inside the welding seam 18, and acted upon by a pressure difference during a suction stroke, said pressure difference resulting from the reduced pressure in the compression chamber and the increased pressure on the pressure side of the compressor, sags. Without the reinforcement plate 40, a sagging in the magnitude of 150 μm could be observed. With the reinforcement plate 40, this sagging was reduced to a harmless magnitude of about 10 μm. Such a reduction can also be achieved with a relatively thin reinforcement plate 40. The thickness of the reinforcement plate 40 is, for example, in the magnitude of 0.2 mm, that is, approximately in the magnitude of the thickness of the suction valve plate 15 and the pressure valve plate 12.

What is claimed is:

1. A piston compressor, particularly a hermetic refrigerant compressor, with a compression chamber, which is limited by a valve plate arrangement having a valve plate with a suction gas opening and a pressure gas opening, a suction valve plate with a suction valve element, and a pressure valve plate with a pressure valve element, wherein the pressure valve plate and the suction valve plate are located on the side of the valve plate facing the compression chamber;

wherein the valve plate, the pressure valve plate and the suction valve plate are undetachably connected with each other;

wherein a connection is provided, which connects the valve plate, the pressure valve plate and the suction valve plate at a common position;

wherein the connection is made in the form of a line, which surrounds an area around a pressure valve; and wherein the suction valve plate has at least one slot-like opening, which follows the course of the line.

2. The compressor according to claim 1, wherein the suction valve plate forms a pressure valve seat for the pressure valve element and the pressure valve plate forms a suction valve seat for the suction valve element.

3. The compressor according to claim 1, wherein with intermediate mounting of a reinforcement plate, the pressure valve plate and the suction valve plate are located on the side of valve plate, which exists in the form of a stiffening element, facing the compression chamber.

4. The compressor according to claim 3, wherein the suction valve plate, the reinforcement plate and the pressure valve plate have substantially the same thickness.

5. The compressor according to claim 3, wherein the reinforcement plate forms a pressure valve seat for the pressure valve element and a suction valve seat for the suction valve element.

6. The compressor according to claim 1, wherein the suction valve plate and the pressure valve plate are made of spring steel.

7. The compressor according to claim 1, wherein the connection is made as a welded connection.

8. The compressor according to claim 1, wherein the side of the valve plate facing the compression chamber has a bearing surface for the pressure valve element located in the pressure gas opening.

9. The compressor according to claim 1, wherein the valve plate, the pressure valve plate, and the suction valve plate have corresponding recesses in the area of their circumferences, in which projections of a cylinder element surrounding the compression chamber engage.

10. The compressor according to claim 9, wherein the valve plate arrangement bears, with intermediate mounting of a sealing, on a bearing surface of the cylinder element, which is formed by a diameter extension of the cylinder element.

11. The compressor according to claim 10, wherein the valve plate arrangement is connected with a flange surrounding the bearing surface, and compresses the sealing.

12. The compressor according to claim 9, wherein the recesses in the valve plate only penetrate partly through the thickness of the valve plate.

13. The compressor according to claim 1, wherein a recess surrounds the suction gas opening and / or the pressure gas opening in the valve plate.

14. The compressor according to claim 3, wherein the suction valve plate, the reinforcement plate and the pressure valve plate are made of spring steel.

15. The compressor according to claim 3, wherein the valve plate, the pressure valve plate and the reinforcement plate and the suction valve plate are undetachably connected with each other.

16. The compressor according to claim 15, wherein a connection is provided, which connects the valve plate, the pressure valve plate, the reinforcement plate and the suction valve plate at a common position.

17. A valve plate arrangement for a piston compressor, the arrangement comprising:

a valve plate with a suction gas opening and a pressure gas opening;

a pressure valve plate with a pressure valve element; and a suction valve plate with a suction valve element;

wherein the pressure valve plate and the suction valve plate are arranged on the same side of the valve plate and undetachably connected thereto; and wherein the valve plate, the pressure valve plate and the suction valve plate are undetachably connected by at least one connection substantially surrounding the pressure valve opening, but not the suction valve opening.

18. The valve plate arrangement according to claim 17, wherein the at least one connection is a welded seam.

19. A valve plate arrangement for a piston compressor, the arrangement comprising:

a valve plate with a suction gas opening and a pressure gas opening;

a pressure valve plate with a pressure valve element; and a suction valve plate with a suction valve element;

wherein the pressure valve plate and the suction valve plate are arranged on the same side of the valve plate and undetachably connected thereto;

wherein the valve plate, the pressure valve plate and the suction valve plate are undetachably connected by at least one welded seam; and wherein a weld bead of the at least one welded seam is at least partially accommodated in at least one slit formed in the suction valve plate.

20. The valve plate arrangement according to claim 19, wherein the at least one welded seam at least partially penetrates the valve plate, the pressure valve plate and the suction valve plate.

21. The valve plate arrangement according to claim 20, wherein the at least one welded seam completely penetrates the pressure valve plate and the suction valve plate.

22. The valve plate arrangement according to claim 20, wherein the valve plate arrangement further comprises a reinforcement plate arranged between the pressure valve plate and the suction valve plate, and the at least one welded seam at least partially penetrates the valve plate, the pressure valve plate, the reinforcement plate and the suction valve plate.

23. The valve plate arrangement according to claim 22, wherein the at least one welded seam completely penetrates the pressure valve plate, the reinforcement plate and the suction valve plate.

* * * * *